US009260209B2

(12) United States Patent
Henriksen

(10) Patent No.: US 9,260,209 B2
(45) Date of Patent: Feb. 16, 2016

(54) CONTAINER CLOSURE APPLICATION SYSTEM AND METHOD

(76) Inventor: Jørgen Henriksen, Charlottenlund (DK)

( * ) Notice: Subject to any disclaimer, the term of this patent is extended or adjusted under 35 U.S.C. 154(b) by 1586 days.

(21) Appl. No.: 11/578,925

(22) PCT Filed: Apr. 20, 2005

(86) PCT No.: PCT/DK2005/000271

§ 371 (c)(1),
(2), (4) Date: Aug. 7, 2007

(87) PCT Pub. No.: WO2005/102842

PCT Pub. Date: Nov. 3, 2005

(65) Prior Publication Data

US 2008/0028728 A1 Feb. 7, 2008

(30) Foreign Application Priority Data

Apr. 20, 2004 (DK) ..... 2004 00619
Sep. 21, 2004 (DK) ..... 2004 01432

(51) Int. Cl.

| | |
|---|---|
| ***B65B 7/28*** | (2006.01) |
| ***B65B 61/02*** | (2006.01) |
| ***B65B 55/08*** | (2006.01) |
| ***B65B 7/16*** | (2006.01) |
| ***B65B 55/10*** | (2006.01) |

(52) U.S. Cl.

CPC ..... *B65B 7/2814* (2013.01); *B65B 7/168* (2013.01); *B65B 55/08* (2013.01); *B65B 55/103* (2013.01); *B65B 61/02* (2013.01)

(58) Field of Classification Search

CPC ..... B65B 7/28; B65B 7/168; B65B 61/02; B65B 55/08

USPC ..... 53/111 RC, 128.1, 167, 290, 296, 300, 53/309, 319, 140–141, 309.3

See application file for complete search history.

(56) References Cited

U.S. PATENT DOCUMENTS

| | | | | |
|---|---|---|---|---|
| 2,378,041 A | | 6/1945 | Sebell | |
| 3,527,020 A | * | 9/1970 | Mancini | 53/282 |
| 3,561,668 A | | 2/1971 | Bergstrom | |
| 3,625,801 A | | 12/1971 | Reed et al. | |

(Continued)

FOREIGN PATENT DOCUMENTS

| | | |
|---|---|---|
| CA | 1075212 | 4/1980 |
| CA | 2006881 A1 | 12/1990 |

(Continued)

OTHER PUBLICATIONS

International Search Report PCT/DK2005/000271 Dated Jul. 25, 2005.

(Continued)

*Primary Examiner* — Michelle Lopez
(74) *Attorney, Agent, or Firm* — Knobbe, Martens, Olson and Bear, LLP

(57) ABSTRACT

The invention relates to a container closure application system comprising a feeder mechanism for advancing a closure blank to a container and a compartment for bringing the closure blank in register with an opening of the container, wherein succeeding closure blanks are provided as a web. The invention furthermore relates to a method for applying closures to a container by means of such system, a web of closure blanks or membranes, and a method for preparing such a web.

30 Claims, 4 Drawing Sheets

(56) References Cited

U.S. PATENT DOCUMENTS

Figure 1:
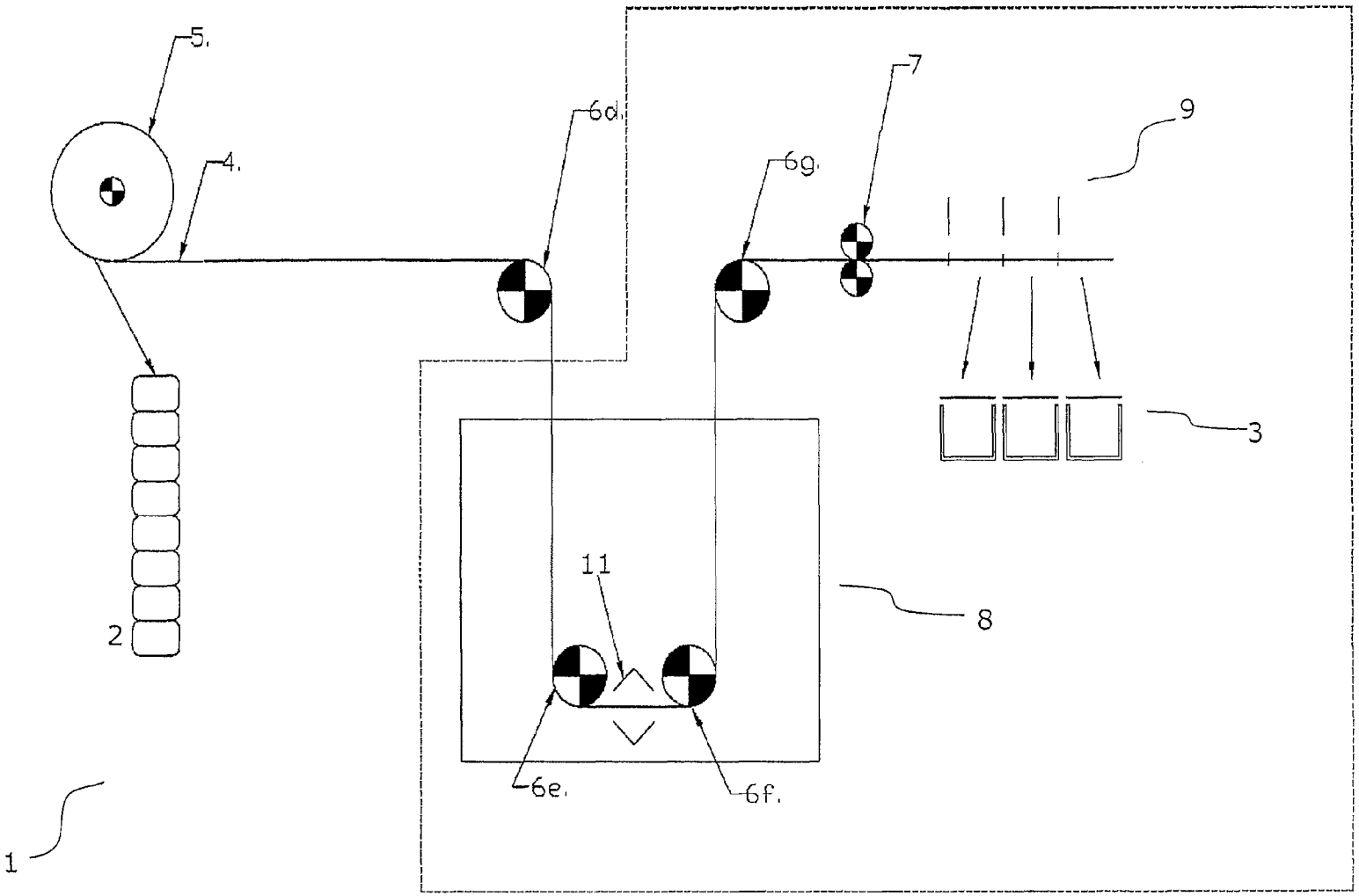

| | | | | | |
|---|---|---|---|---|---|
| 3,708,954 | A | | 1/1973 | Wilke et al. | |
| 3,775,934 | A | | 12/1973 | Smith | |
| 3,927,506 | A | | 12/1975 | Abd-Alba | |
| 4,040,561 | A | | 8/1977 | Philippon | |
| 4,512,133 | A | * | 4/1985 | Torterotot | 53/167 |
| 4,563,855 | A | | 1/1986 | Smith et al. | |
| 4,625,498 | A | | 12/1986 | Parsons | |
| 4,683,016 | A | | 7/1987 | Dutt et al. | |
| 4,819,412 | A | | 4/1989 | Sengewald | |
| 4,819,413 | A | | 4/1989 | Mancini | |
| 4,866,913 | A | | 9/1989 | Rebischung | |
| 4,978,056 | A | | 12/1990 | Ball et al. | |
| 5,140,882 | A | | 8/1992 | Hyder | |
| 5,566,529 | A | * | 10/1996 | Sireix | 53/412 |
| 5,606,847 | A | * | 3/1997 | Joensson et al. | 53/471 |
| 6,134,866 | A | * | 10/2000 | Schoenewolff et al. | 53/561 |
| 6,199,347 | B1 | | 3/2001 | Muller et al. | |
| 6,820,401 | B2 | * | 11/2004 | Behnke | 53/486 |
| 6,823,652 | B2 | * | 11/2004 | Troxtell, Jr. | 53/427 |

FOREIGN PATENT DOCUMENTS

| | | | |
|---|---|---|---|
| CN | 87108346 | | 12/1887 |
| CN | 1241161 | A | 1/2000 |
| EP | 0065380 | | 11/1982 |
| EP | 0897869 | | 2/1999 |
| EP | 0919246 | | 6/1999 |
| FR | 1538738 | | 9/1968 |
| FR | 2566738 | | 1/1986 |
| GB | 908544 | | 10/1962 |
| GB | 1207470 | | 10/1970 |
| GB | 2250973 | | 6/1992 |
| WO | WO 98/19956 | | 5/1998 |
| WO | WO 01/23259 | | 4/2001 |

OTHER PUBLICATIONS

European Patent Office Search Report issued on Oct. 29, 2008 in the corresponding European Application No. 0816343.7.

* cited by examiner

CONTAINER CLOSURE APPLICATION SYSTEM AND METHOD

CROSS REFERENCE TO RELATED APPLICATION

This application claims priority to and is a U.S. National Phase of PCT International Application Number PCT/DK2005/000271, filed on Apr. 20, 2005, designating the United States of America and published in the English language, which claims priority under 35 U.S.C. §119 to Denmark Patent Application Numbers PA 2004 00619 filed on Apr. 20, 2004 and PA 2004 01432 filed on Sep. 21, 2004. The disclosures of the above-described applications are hereby incorporated by reference in their entirety.

The present invention relates to a container closure application system and a method for applying a closure to a container. In particular the container may be a single serving foodstuff container, a family size serving foodstuff container, a foodstuff container sized for wholesale trades or the like.

BACKGROUND OF THE INVENTION

Traditionally, fresh dairy products like cheese, Ice-cream, yoghurt, salads in particular tuna salad, vegetable mayonnaise, fish salads or the like, are prepared and filled into suitable containers, which are afterwards provided with a closure or lid, all performed more or less manually. Demands for better food safety and hygiene standards have more recently led food suppliers to move away form this traditional way toward a more automated system.

One known dairy product machine automatically fills the fresh dairy product into suitable containers, which are subsequently fitted with individual, pre-shaped closures fed from a stack of loose closure blanks. Other known diary product machines close the containers by interconnected closures that may be separated after the closures have been applied. To reduce the risk of contamination of the fresh dairy product during packaging, the whole dairy product machine may be encapsulated in a housing having a controlled atmosphere.

SUMMARY OF THE INVENTION

An objective of the present invention may be to provide a hygienic and cost-effective container closure application system and method as well as a web of closure blanks or membranes to be applied in such system and a method for preparing these.

Another objective of the present invention may be to provide a container closure application system and method with which it is possible to apply closures to containers that are spaced apart by a distance different from the distance between the centres of two succeeding closures.

In a first aspect, the present invention relates to a container closure application system comprising a feeder mechanism for advancing a closure blank to a container and means for bringing the closure blanks in register with an opening of the container, wherein succeeding closure blanks are provided as a web. Hereby is provided a container closure application system in which the laborious task of providing stacks of individual closure blanks is avoided. Another advantage associated with the system is that the risk of production stop due to lack of closures or jam in the system is minimised, providing a more efficient production without unscheduled stops. This further provides for long production periods without manual interference, and hence a controlled atmosphere can be maintained. Further the risk of contamination of the closure blanks is considerably reduced compared to a system utilising a stack of loose closure blanks, which may be difficult to keep free of contamination. Such contamination may be caused by any accidental dropping on the floor by an operator or the like, or just fingerprints on individual blanks set when placing a stack of blanks.

In a preferred embodiment of the invention, the distance between the centres of succeeding closure blanks differs from the distance between the centres of succeeding containers when the containers are ready for having closure blanks applied. The distance between the centres of succeeding closure blanks may be smaller than the distance between the centres of succeeding containers. Hereby the amount of material used for the closure blanks can be kept to a minimum also in systems used for containers positioned spaced apart when ready to have closure blanks applied. By the centre of a closure blank is meant the geometrical midpoint of the area defined by the outer rim of a closure blank. By the centre of a container is meant the corresponding point In the plane suspended by the upper flange or edge of the container.

The web may for example be folded to a stack, which may be advantageous if the closure blanks have a substantial thickness. According to an embodiment, however, the web is provided as a roll, which is found to provide a smooth feed to the system. Each roll may comprise one row of closure blanks or it may comprise two or more rows. According to an embodiment, the web of closure blanks is provided with weakenings, such as perforations, between adjacent closure blanks. Hereby the closure blanks are detachable in that they may easily be separated from each other In a separation station by tearing or by cutting with e.g. a mechanical knife, a pair of mechanical scissors, a water jet cutter, a laser cutter, or another suitable means for separating.

The system may further comprise means for separating the closure blanks prior to application to the containers. The closure blanks may be applied as a web of interconnected closure blanks, however it may often be advantageous to detach the closure blanks to facilitate application of the closure blanks to the containers. It may also be possible to keep groups of closure blanks interconnected but detached from other groups.

If considered necessary or advantageous, the system may further comprise sterilisation means for sterilisation of the closure blanks, such as UV-sterillsation means. The UV-sterilising means may preferably comprise UV-lamps directing UV-radlation towards one or both sides of the closure blanks. The sterilising means comprise in preferred embodiments means for contacting the closure blanks with a sterilising fluid. Such means may preferably comprise a bath of sterilising fluid through which the closure blanks are passed, and the sterilising fluid may preferably be hydrogen peroxide. Furthermore, drying means may advantageously be used for drying the closure blanks the surfaces thereof having been contacted with the sterilising fluid. In preferred embodiments, a combination of the UV-sterilising means and the means for contacting the closure blanks with a sterilising fluid is utilised. Alternatively or supplementary the closure blanks may be sterilised prior to installation in the system.

The closure blanks may be fitted loosely to the containers, or be fixed to the containers, such as by an adhesive. According to an embodiment, however, the device comprises means for fixing a closure blank to a periphery of the opening of the container, such as by thermo-sealing, laser welding or laser soldering. Other suitable ways of bonding include ultrasound welding.

In preferred embodiments, the invention may comprise membrane-dispensing means for arranging a membrane in the container in a position being underneath the position of a closure blank. The membranes are typically and preferably provided as a web and are separated from each other before being arranged in the containers. In a preferred embodiment of the invention, the membranes are not sealed to the container but allow for exchange of some of the content of the container between the spaces beneath and above the membrane.

In a particularly preferred embodiment, the membrane-dispensing means comprise a sucking disc means arranged on an arm, wherein the membrane-dispensing device may be adapted to take a membrane from a position above the opening of the container and convey the membrane to a position within the container in the vicinity of the opening.

At least part of the advancing, separating, sterilising, drying, arranging and/or fixing, including the application of the closure blanks to the containers, may take place in a compartment being sealed from the exterior. Hereby it may e.g. be avoided that the closure blanks and the membranes are contaminated after having been sterilised. Another aspect of the invention relates to a method for applying a closure blank to a container having an opening so that the closure blank covers said opening, the method comprising the steps of:

advancing of a closure blank to the container, bringing the closure blank in register with the opening of the container.

According to an embodiment, the closure blanks are provided as a web of adjacent, interconnected closure blanks, and the method includes the step of separating a closure blank from the web. Preferably, the separation of the closure blank from the web is carried out during at least substantially the same movement of a part of the separating station that brings the closure blank in register with the opening of the container. If considered necessary or advantageous, the method may further include the step of sterilising the web of closure blanks. The step of sterilising the closure blanks may preferably comprise exposing the closure blanks to UV-radlation and/or exposing the closure blanks to a sterilising fluid which preferably may be followed by a drying step drying the closure blanks. The sterilising fluid may preferably be hydrogen peroxide.

According to an embodiment of the invention, the method further comprises the step of fixing the closure blanks to a periphery of an opening of the container, such as by thermosealing.

Preferred embodiments may further comprise the step of arranging a membrane in the container in a position underneath the position of a closure blank before the closure blank is applied.

The membranes may be provided as a web of adjacent, interconnected membranes, and the method may then include the step of separating a membrane from the web. The membranes may also be provided as separate sheets fed individually, such as in a pile, to the position from where they are arranged in the containers.

In a third aspect, the invention relates to a web of closure blanks or membranes adapted for use in the system and method according to the first and second aspects In that the closure blanks are interconnected and in that, during preparation of the closure blanks, all material in excess of the closure blanks is removed. Hence, according to the third aspect, the invention provides a web of interconnected closure blanks or membranes formed in a flat sheet of flexible material, wherein adjacent closure blanks or membranes abut each other along weakened portions of the sheet and are separable along said weakened portions, and wherein a shape of each closure blank or membrane is defined by said weakened portions and/or rims of the sheet so that the web contains no material in excess of the closure blanks or membranes.

In the present description, the term interconnected means that adjacent closure blanks or membranes are connected along lines which form part of the outer perimeters of the respective closure blanks or membranes so that there is no middle piece between adjacent closure blanks or membranes. In other words, the web is prepared so that it contains no material in excess of the closure blanks or membranes, which eliminates the need for trimming the closure blanks or membranes after separation or application to a container. As a result, the web of closure blanks or membranes leaves no excess material in the separation station of the container closure application system. This is an advantageous solution compared to the prior art since handling will be easier and material costs are decreased. As mentioned previously, the separation may be performed by tearing or cutting.

In a preferred embodiment the closure blanks consist of a material with good sealing properties i.e. Impervious to liquids, light and air. The material will be of a kind approved for use with articles of food, e.g. dairy products. Furthermore, the material preferably has sufficient strength to prevent any curling of the closure blanks when handled. The material for the closure blanks may be of a laminar structure comprising two or more layers of the same or different materials. The material for the closure blanks is preferably a plastic or aluminium foil or a laminate thereof with sealing properties. The material for the membranes is preferably a parchment, but it may also be a plastic or aluminium foil or a laminate thereof.

In a fourth aspect, the invention relates to a method for preparing a web of interconnected closure blanks or membranes. A flat sheet of flexible material may be advanced past a shaping station in which a shaping tool applies the relevant shape to the closure blanks or membranes by forming weakened portions of the sheet thereby defining boundaries between abutting closure blanks or membranes. The shaping tool may also form outer boundaries of the closure blanks or membranes by removing all material in excess of the closure blanks or membranes. The advancing web of closure blanks or membranes may then advantageously be wound onto a roll or stacked in a pile while keeping the closure blanks or membranes interconnected. The web may also be divided into two or more rows of interconnected closure blanks or membranes and may subsequently be wound onto a corresponding number of rolls. This provides particular advantages since it is possible to draw the web of closure blanks or membranes from a stack or a roll continuously through a production line while minimising the risk of jamming and subsequent production stop.

In a preferred embodiment the shaping tool is a roller puncher or rotating die cutter defined as a cylinder shaped tool where the outer surface is provided with protruding parts in a pattern shaped to punch or cut the desired shape and size of the closure blanks or membranes.

In other preferred embodiments the shaping tool may be constituted by a mechanical knife, a pair of mechanical scissors, a water jet cutter, a laser cutter, or another suitable means for shaping or cutting.

DETAILED DESCRIPTION OF THE INVENTION

Figure 2:
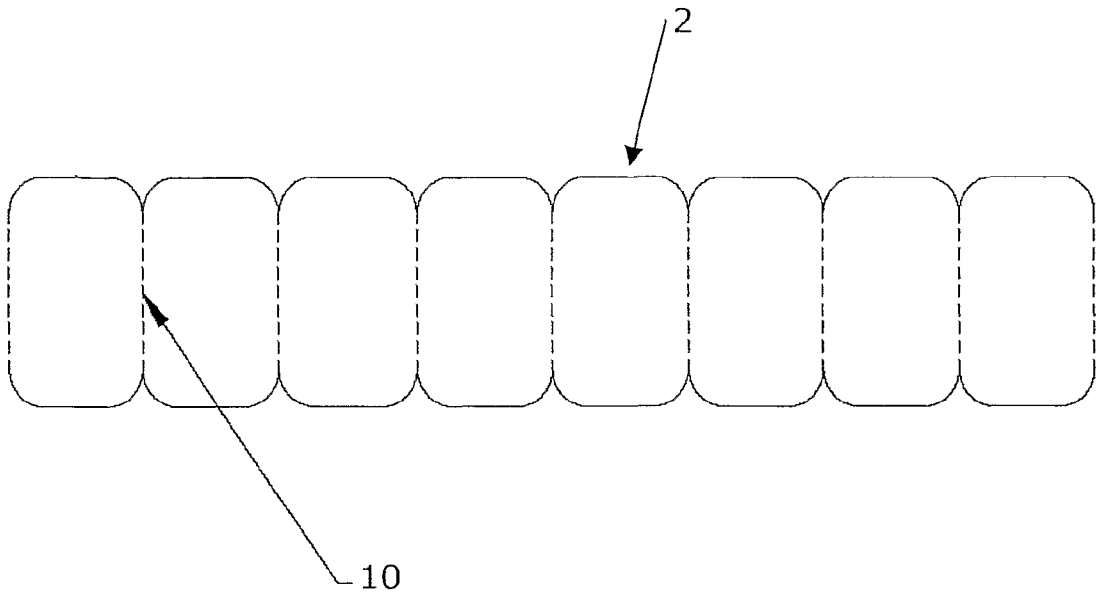
Figure 3:
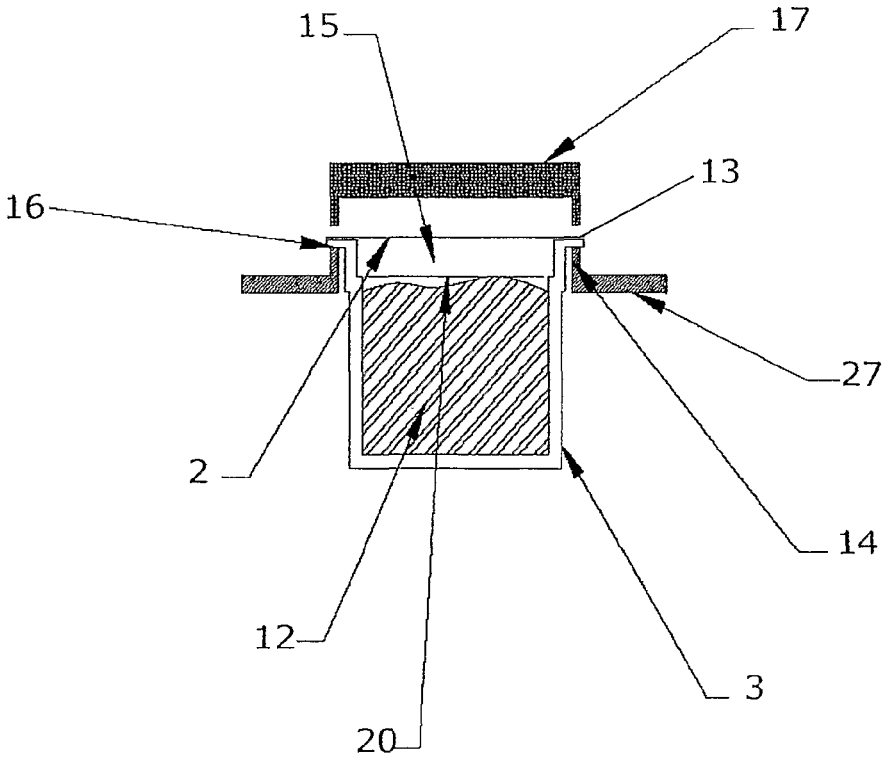
Figure 4:
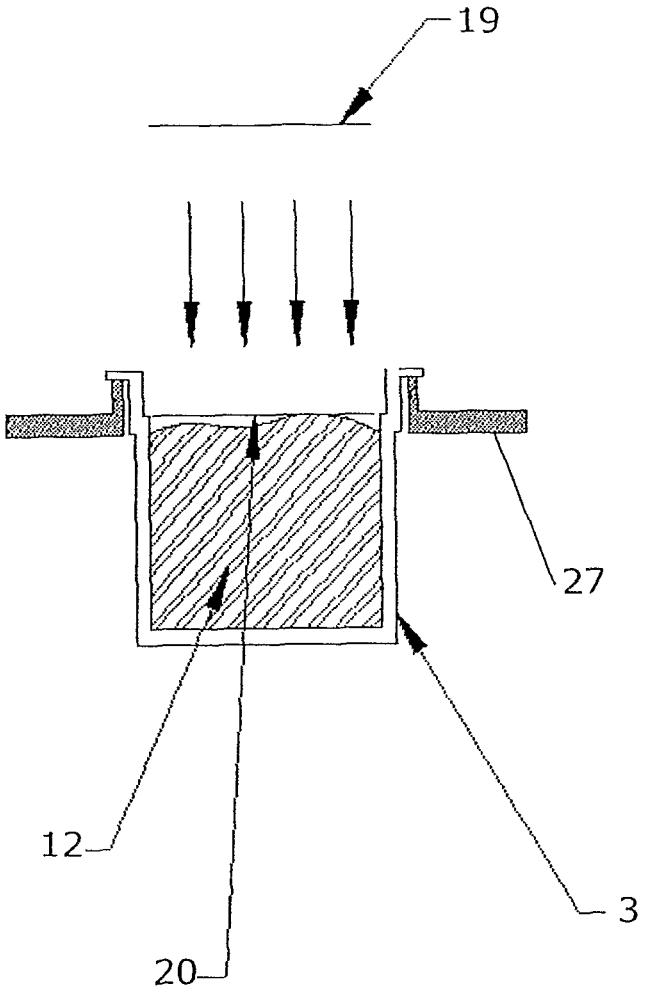
Figure 5:
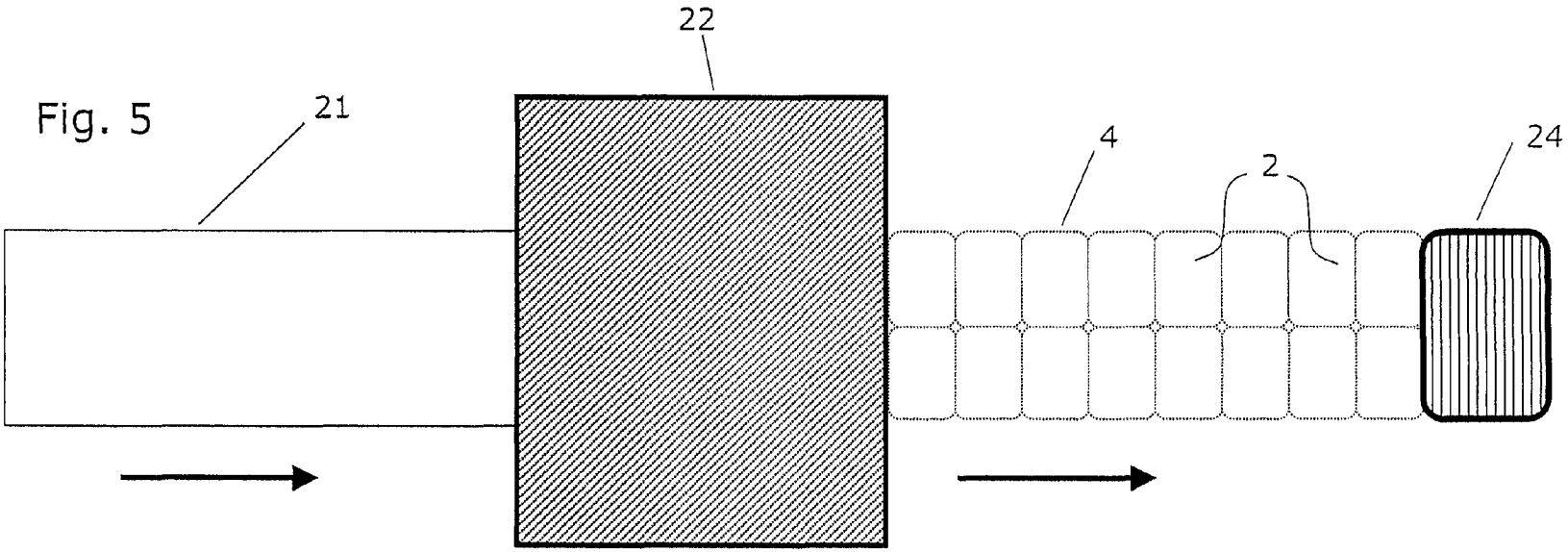
Figure 6:
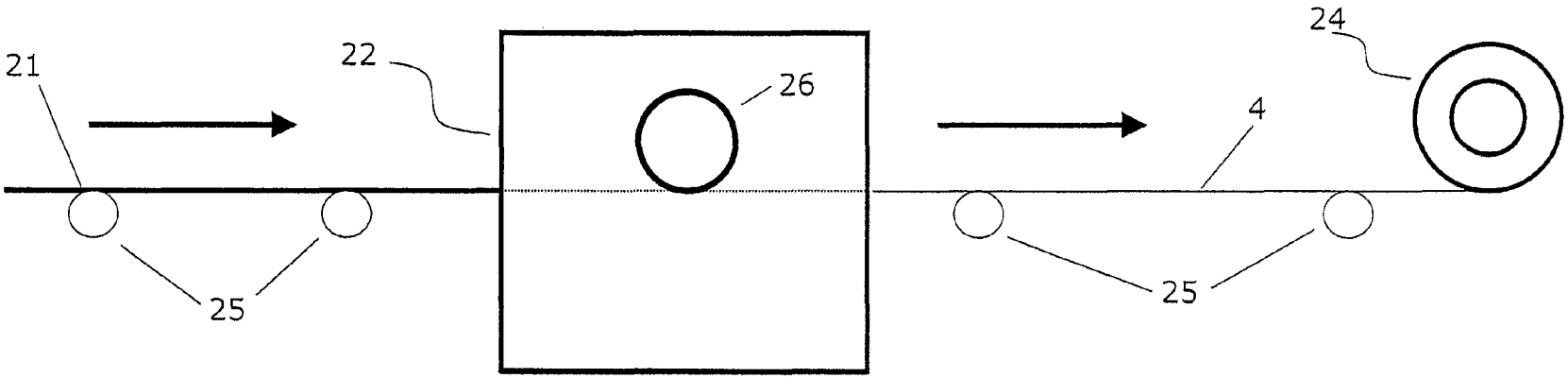

The invention will be described in more detail in the following by way of examples and with reference to the schematic drawings, in which FIG. 1 is a side view of a system according to the invention, FIG. 2 is a plan view of a web of closure blanks for the system, FIG. 3 is a cross-sectional view of a container closure application station of the system, FIG. 4 is a cross-sectional view of a membrane application system of the system, FIG. 5 is a plan view of the method of preparing the closure blanks according to the invention, FIG. 6 is a side view of the method shown In FIG. 5.

In FIG. 1 is seen a container closure application system 1 provided with a reel 5 which carries a web 4 of closure blanks 2. The web 4 is made of a thin, flexible material, such as an aluminium foil or film. The web 4 is fed from the reel 5 via guide rollers 6*d-g* to a separation and application station 9 for separation of the individual closure blanks 2 of the web 4. The set of rollers 7 advances the web 4 from the reel 5 and to the separation station 9 by drawing in the web 4. After leaving the rollers 7, the closure blanks are advanced by the pushing action of the succeeding material. Separation of the closure blanks 2 may be performed as a punching process by a punch having a sharp edge portion with an outline in the desired shape of the closure blank 2. The separation may alternatively be provided by tearing or by any kind of scissors or knife, such as a sleigh with a knife travelling across the web at suitably spaced locations to form the closure blanks 2. In an embodiment, however, two adjacent closure blanks 2 are individually fixed, such as by suction cups, and forced apart to separate along a line of weakness as will be described in more detail with reference to FIG. 2. As schematically illustrated the system 1 may be provided with a sterilising means 11 sterilising on one or both sides of the web 4 prior to application of the closure blanks to the containers 3. The sterilising means 11 is preferably uv-lamps or the like and such means are arranged on one or both sides of the web 4. The sterilising means 11 is furthermore arranged in sterilisation station 8 being a shielded area 8 for instance in the form of a box.

In an alternative embodiment, the sterilising means 11 is a bath of sterilising fluid, such as hydrogen peroxide, through which the web 4 of closure blanks 2 passes. The bath is typically a container having guide rollers whereof one or more is submerged in the sterilising fluid so as to guide the web 4 of closure blanks 2 into and out of the sterilising fluid. Drying of the closure blanks 2 after they have been sterilised in the bath of sterilising fluid is preferably achieved by directing a stream of dry air towards the closure blanks 2. The air stream may be generated by a blower or fan (not shown) placed in connection with the sterilising station and the dry air is preferably sterilised by letting the air stream pass through a sterilising air filter in order to avoid contamination of the newly sterilised closure blanks 2. In a further embodiment, the sterilising means 11 comprises both the uv-lamps and the bath of sterilising fluid.

As Illustrated In FIG. 1 application of the closure blanks 2 on the openings of the containers 3 takes place in a compartment 18. This compartment is sealed of from the exterior so that a sterile atmosphere can be obtained within the compartment to avoid contamination of the ingredients arranged in the containers 3 as well as the containers 3 and closure blanks 2. The sterilisation stations 8 may advantageously be arranged within the compartment 18 in order to avoid contamination of the closure blanks once they have been sterilised. In such embodiments, the web 4 is fed to the sterilising station 8 being a part of the sealed compartment 18.

The treatment of the containers may comprise several steps in addition to the filling of the containers with the main content. These steps will be directly related to the actual main content with which the containers are to be filled. The containers may e.g. be sprayed with an anti-stick spray, such as oil, and/or with an anti-foam spray to prevent undesired build-up of air bubbles in the content of the containers.

When membranes are also applied to the containers, the advancement and sterilisation of the membranes may take place in the same way as described for the closure blanks and preferably within the sealed compartment 18. However, the membranes may also be treated in a separate compartment and fed into the compartment 18 at any stage before they are to be applied to the containers.

FIG. 2 illustrates a part of the web 4 having closure blanks 2 preformed therein and having a line of weakness 10 between adjacent closure blanks. The line of weakness may be provided as a perforation, a score, or any other suitable weakening. The closure blanks 2 are preformed to closely match the container 3, so that trimming of the closure blanks is unnecessary. The line of weakness 10 of the web 4 between the closure blanks 2 can be carefully designed to break without any scrap being formed. FIG. 2 shows one possible shape of the closure blanks, but any desirable geometry is possible within the scope of the invention. FIG. 2 may also illustrate a possible shape of the membranes. In FIG. 3 can be seen a container closure application station of the system 1. The container 3 is held in a recess 14 of a tool 27. The container may be provided with an outwardly extending flange 13 around an opening 15 thereof, and the flange 13 may rest on an edge 16 of the tool 27. The edge 16 then suitably provides an abutment face to sandwich the closure blank 2 and the flange 13 with a device having heated sealing elements 17 to form thermal seals at the contact between the container 3 and the closure blank 2, to provide a sealed package. The container 3 may contain a product 12, such as a fresh dairy product like fresh cheese, yoghurt, ice cream or the like, salads In particular tuna salad, vegetable mayonnaise, fish salads or the like. A membrane 20 may placed on top of the product before the closure blank is applied.

A set or string of individual containers may be interconnected at the flanges if considered convenient or advantageous (not shown). In this case the system may further comprise cutters to wholly or partially cut through the flanges to separate the individual containers or groups of containers before or after application of the closures, so that individual containers can be broken or snapped apart. It may be convenient to retain at least some containers together during storage and transport, yet rendering them easily separable from one another by being snapped apart.

The containers may be made of any suitable material known in the art and which has sufficient strength to withstand normal conditions encountered during manufacture and handling. Suitable materials for this purpose can be e.g. polypropylene (PP), polyethylene terephthalate (PET), polystyrene (PS) etc. The material for the container may be thermoformable, to enable cost-effective manufacture of the containers.

The closure blanks can be comprised of any suitable material known in the art and which has sufficient strength to withstand normal condition encountered during manufacture and handling of the resulting package, yet flimsy enough to be manually peelable using normal force. One particular material, which is suitable for this purpose, is a film or foil of aluminium. If considered necessary or convenient, the film or foil may be coated.

The material for the closure blanks can also be of a laminar structure having two or more layers of the same material or two or more layers of different materials. Such materials may be chosen from a number of thin and flexible plastics, e.g. polypropylene (PP), polyethylene terephthalate (PET), polystyrene (PS), or metal films such as aluminium films or foils etc. The production of a laminate may involve metallizing and/or dyeing/colouring of layers in the laminate. The metallizing of a layer can be obtained by adhering e.g. aluminium to a plastic layer or alternatively by coating a plastic layer with adhesives with a spray of metallic particles.

The configuration and/or composition of the laminate determine properties of the closure blanks, e.g. color, surface/text readablity, appearance, strength, flexibility, permeability, insulation properties etc.

Laminating the individual layers into a laminate may be performed by exposing the layers to high pressure rolling or pressing or may be a result of a heat-sealing process. The heat-sealing process typically involves the use of a heat-seal lacquer for application between two or more layers thereby providing the necessary bonding between them.

One example of the composition of the material for the closure blanks can be a laminate comprising a bottom layer of PP with a thickness of 20-30 μm, an intermediate aluminium or metallized layer of PET with a thickness of 12-20 μm and an upper layer of PET with a thickness of 12-20 μm, adding to a typical thickness of 60 μm including adhesive. This example is merely one among many others possible and is only intended for illustrative purposes and should therefore not be regarded as a limitation of the scope of the application.

The system according to the invention will be advantageous for application of closures to any kind of containers as it is automatic and cost-effective. However the system is especially suited for the food industry, the pharmaceutical industry and similar industries having high standards of hygiene. One main advantage of the system is that it provides for a scrap-free application of closures to the containers, avoiding handling of scrap and the risk of contamination of the contents of the containers of e.g. scraps from trimming of the closures or the like.

In particular the container may be a container for foodstuffs, such as dairy products like fresh cheese, yoghurt, ice cream, salads in particular tuna salad, vegetable mayonnaise, fish salads or the like.

The system is particularly advantageous in an installation for producing fresh cheese, especially white cast cheese. Such installations comprise means for providing a continuous production over several hours, without any manual input. Such installations are often encapsulated in a housing with a controlled atmosphere, and the complete production and packaging of the cheese takes place within the housing. This means e.g. that the packaging should be very clean to avoid any contamination of the production and the product, and the packaging should be a continuous, in-line process, all of which is achieved by the system and process according to the invention.

The system may further comprise a membrane application system as shown schematically In FIG. 4. The membrane is preferably placed in the container in a way that allows exchange of some of the product between the space below and above the membrane. The membranes 20 may similarly to the closure blanks 2 be provided as a web of membranes arranged on a reel arranged in register with the openings of the containers in a manner similar to the way the closure blanks 2 are arranged in register with the containers. Application of the membranes may be done by use of a membrane-dispensing device 19 comprising a sucking disc means arranged on an arm (not shown). The membrane-dispensing device 19 takes a membrane 20 from a position above the open end of the container and conveys the membrane 20 to the top of the product as indicated by the vertical arrows in FIG. 4.

Instead of the tool 27 of FIGS. 3 and 4, the sealing between the container 3 and the closure blank 2 and/or membrane 20 can, in an alternative embodiment, be performed by laser welding or soldering. Laser welding is particularly suitable when both the container and the closure blank or membrane are both formed in polymeric materials such as plastics. In determining suitable materials and welding techniques, it is important to consider the types of polymeric materials and their optical properties (absorption and transmission) at the relevant wavelengths, the laser wavelength and application characteristics as well as creating a good contact between the materials in the relevant areas.

The system may further comprise an additional lid application station (not shown) to fit an additional, preferably reclosable, lid to the container to protect the relatively vulnerable, thin film or foil constituting the sealed closure on the container. This lid may also be refitted after the closure is peeled-off by a consumer to protect the contents of the container.

FIGS. 5 and 6 schematically illustrate one possible preparation of a web 4 of interconnected closure blanks 2 used in the system 1 described in relation to FIG. 1. A flat sheet of flexible material 21, preferably a plastic or aluminium foil with good sealing properties, is advanced in the direction of the arrows. The advancing can be performed by a number of rollers 25 acting on one or both sides of the flexible sheet, or by other suitable driving means. Alternatively, the advancing can be performed by jaws gripping and pulling the web.

The sheet 21 is guided through a shaping station 22 in which a shaping tool 26 performs an operation on the sheet resulting in the formation of a web of interconnected closure blanks 2. The shaping tool 26 is preferably a roller puncher or a rotating die cutter, but the shaping may also be performed by a mechanical knife, a pair of mechanical scissors, water jet cutting, laser cutting or other suitable means. Alternatively, the shaping tool 26 can be a combination of two or more of these. All sheet material in excess of the closure blanks 2 is punched out or cut off as a result of the shaping and can be disposed of e.g. by conveyors or other transportation means In connection with the shaping station 22 (not shown).

In order for the web 4 to fit the configuration of containers 3 in connected sets or strings, the shaping tool 26 can shape the flexible sheet material 21 into one or more parallel and possibly interconnected rows of closure blanks 2. In FIG. 5 a number of two parallel rows is illustrated, which may be wound onto one roll or divided and wound onto two, separate rolls. Depending on production needs, the web 4 may be divided into any number of rows and wound onto a corresponding number of rolls.

Upon completion of the shaping of the closure blanks, the continuously advancing web 4 can be guided to a storage position 24, preferably by winding the web onto a reel 5 which, is found to provide a smooth feed to the system 1 of FIG. 1. However, the closure blanks can also be folded to stack, which may be advantageous if the closure blanks have a substantial thickness.

A corresponding method as illustrated in FIGS. 5 and 6 may be used for the preparation of a web of membranes.

The invention claimed is:

1. A container closure application system (1), said system (1) comprising a feeder mechanism for advancing a plurality of closure blanks (2) to a position above a plurality of containers (3) and means for separating and moving apart the plurality of closure blanks (2) and bringing the plurality of closure blanks simultaneously in register with openings of the respective containers (3), wherein succeeding closure blanks (2) are provided as a web (4) wherein the distance between the centers of succeeding closure blanks (2) in the web is smaller than the distance between the centers of succeeding containers (3) when the containers are ready for having closure blanks applied, and wherein the separating comprises separating the plurality of closure blanks from the web.

2. A system according to claim 1, wherein the web (4) is provided as a roll.

3. A system according to claim 2, wherein the web is provided as a plurality of parallel rows of closure blanks on a plurality of rolls.

4. A system according to claim 1, wherein the web (4) of closure blanks (2) is provided with weakenings (10) between adjacent closure blanks (2).

5. A system according to claim 1, wherein the system (1) is configured to simultaneously separate the plurality of the closure blanks (2) prior to application to the containers (3).

6. A system according to claim 1, wherein the system (1) is configured to sterilize the closure blanks (2).

7. A system according to claim 5, wherein the sterilization comprises UV-sterilization.

8. A system according to claim 6, wherein the sterilization comprises contacting the closure blanks (2) with a sterilizing fluid.

9. A system according to claim 8, wherein the sterilizing fluid comprises a bath of sterilizing fluid through which the closure blanks are passed.

10. A system according to claim 8, wherein the system (1) is further configured to dry the closure blanks (2) the surfaces thereof having been contacted with the sterilizing fluid.

11. A system according to claim 1, wherein the system (1) is configured to fix a closure blank (2) to a periphery of the opening (15) of the container (3).

12. A system according to claim 1, wherein the system (1) is configured to arrange a membrane (20) in the container (3) in a position underneath the position of a closure blank (2).

13. A system according to claim 12, wherein the membranes (20) are provided as a web.

14. A system according to claim 13, wherein the system (1) is configured to separate the membranes prior to application to the containers (3).

15. A system according to claim 13, wherein the system (1) is configured to sterilize the membranes.

16. A system according to claim 15, wherein the system (1) is further configured to dry the closure blanks (2) the surfaces thereof having been contacted with the sterilizing fluid.

17. A system according to claim 12, further comprising a sucking disc arranged on an arm, which is further adapted to take a membrane (20) from a position above the opening (15) of the container (3) and convey the membrane (20) to a position within the container in the vicinity of said opening.

18. A system according to claim 1, wherein the closure blanks match the outline shape of a top flange of the containers.

19. A system according to claim 1, wherein a subset of the plurality of closure blanks is two or more.

20. A system according to claim 1, wherein the feeder mechanism advances a set of closure blanks from the plurality of closure blanks to a position above a respective set of containers from the plurality of containers.

21. A system according to claim 20, wherein the means for separating and moving apart the plurality of closure blanks concurrently separates and concurrently moves apart the set of closure blanks and brings the set of closure blanks simultaneously in register with the openings of the set of containers.

22. A container closure application system (1), said system (1) comprising a feeder mechanism for advancing a set of closure blanks (2) to a position above a respective set of containers (3) and a compartment (18) for simultaneous application of the set of the closure blanks (2) to the respective set of containers (3), wherein succeeding closure blanks (2) are provided as a web (4) and wherein the distance between the centers of succeeding closure blanks (2) is smaller than the distance between the centers of succeeding containers (3) when the containers are ready for having closure blanks applied, wherein the compartment (18) is sealed from the exterior to provide a sterile atmosphere.

23. A system according to claim 22, wherein the web (4) is provided as a roll.

24. A system according to claim 22, wherein the web (4) of closure blanks (2) is provided with weakenings (10) between adjacent closure blanks (2).

25. A system according to claim 22, wherein the web (4) of closure blanks (2) are separated by a shaping tool.

26. A system according to claim 22, further comprising a sterilization station for sterilizing the closure blanks (2), the sterilization station located within the compartment (18), wherein the sterilization station is selected from the group consisting of UV-radiation, sterilizing fluid, and combinations thereof.

27. A system according to claim 22, wherein the feeder mechanism includes a means for concurrently separating and concurrently moving apart the set of closure blanks and bringing the set of closure blanks simultaneously in register with openings of the set of containers.

28. A system according to claim 22, further comprising a tool (27) having a recess for holding a container of the set of containers (3), wherein the container (3) has an opening (15) and an outwardly extending flange (13) around the opening (15) thereof, and wherein the flange (13) of the container (3) rests on an edge (16) of the tool such that the edge suitably provides an abutment face to sandwich a respective closure blank (2) and the flange (13).

29. A system according to claim 22, further comprising a sucking disc arranged on an arm adapted to take a membrane (20) from a position above an opening (15) of a container of the set of containers (3) and convey the membrane (20) to a position within the container in the vicinity of the opening.

30. A container closure application system, the system comprising a feeder mechanism for advancing a plurality of closure blanks from a single reel to a position above a plurality of linearly situated containers and a separation and application station configured to simultaneously separate and simultaneously move apart a subset of the plurality of closure blanks and simultaneously bring them in register with openings of the respective containers, wherein succeeding closure blanks are provided as a web from the single reel.

* * * * *